United States Patent [19]

Matteini

[11] 4,391,206

[45] Jul. 5, 1983

[54] TUBULAR ROTARY FURNACE FOR INCINERATING REFUSE AND THE LIKE, WITH INNER DEMOUNTABLE GRID

[76] Inventor: Silvano Matteini, Via Bellosguardo 4A, Florence, Italy

[21] Appl. No.: 202,897

[22] Filed: Oct. 31, 1981

Related U.S. Application Data

[63] Continuation of Ser. No. 3,906, Jan. 16, 1979, abandoned.

[30] Foreign Application Priority Data

Jan. 18, 1978 [IT] Italy ..... 11535/78[U]

[51] Int. Cl.[3] ..... F23G 5/06

[52] U.S. Cl. ..... 110/246; 110/258; 432/118

[58] Field of Search ..... 110/246, 258; 432/118

[56] References Cited

U.S. PATENT DOCUMENTS 3,431,684 3/1969 Ban ..... 110/246 X 3,830,171 8/1974 Rolli ..... 110/246

*Primary Examiner*—Edward G. Favors

*Attorney, Agent, or Firm*—Hopgood, Calimafde, Kalil, Blaustein & Judlowe

[57] ABSTRACT

Tubular cylindrical rotary furnace for incinerating refuse and the like, equipped at the inner periphery with grid-shaped means (5) inclined towards the inside and in the direction of the cylinder (1) angular feed; each of said grid-shaped means is supported by radial support bars (7) that are radially extractable from the furnace cylindrical shell.

5 Claims, 3 Drawing Figures

TUBULAR ROTARY FURNACE FOR INCINERATING REFUSE AND THE LIKE, WITH INNER DEMOUNTABLE GRID

This is a continuation of application Ser. No. 003,906, filed Jan. 16, 1979, now abandoned.

The invention concerns a tubular—especially cylindrical—rotary furnace for incinerating refuse and the like, equipped at the inner periphery with grid-shaped means inclined towards the inside and in the direction of the cylinder angular feed; each of said grid-shaped means is supported by radial support bars that are radially extractable from the furnace cylindrical shell.

Each grid-shaped means is particularly directly engaged to the inner edge and the outer edge through small bars and at least two substantially radial support bars, by means of longitudinally extractable constraint rods. The support bars can be engaged by means of an outer terminal flange to a structure carried by the furnace shell and forming the radial insertion seat of the bar.

With the described arrangement a particularly simple and economical embodiment is obtained which is further capable to readily allow the disassembly for maintenance and replacement, while the furnace functionality is improved by virtue of the possibility to have more burning air flowing on the material, when the material is raised and falls in the furnace lower zone. The drawing shows a possible embodiment of the invention and particularly:

Figure 1:
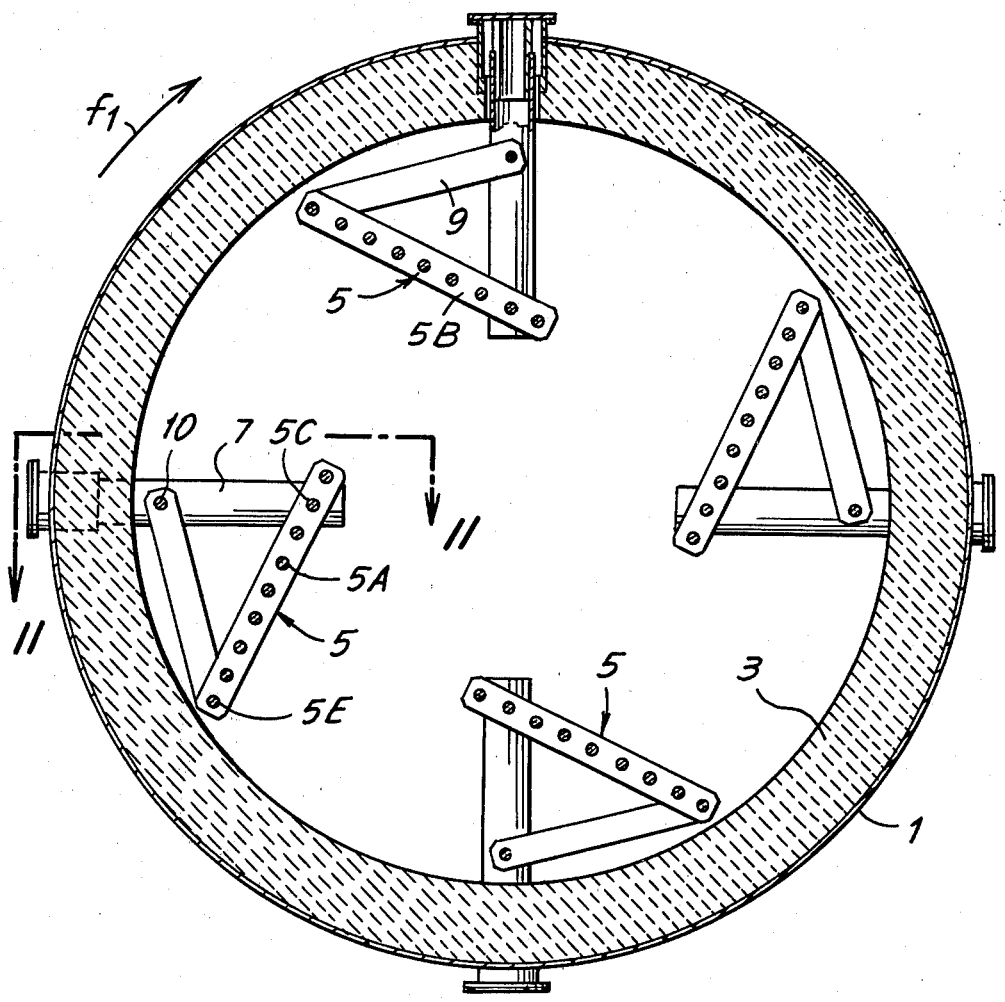
FIG. 1 shows a diagram of a cross-section view of the furnace.
Figure 2:
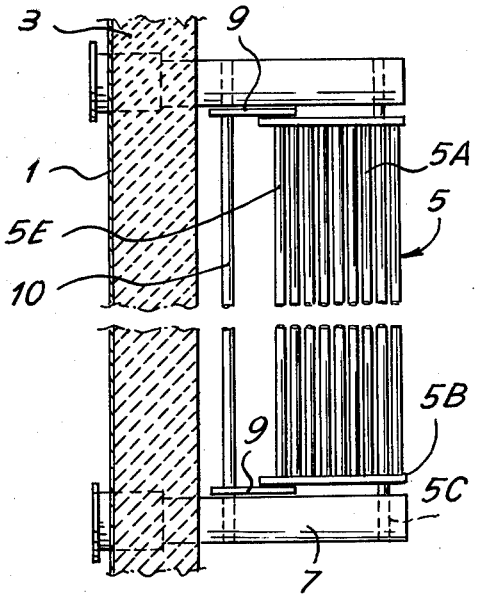
FIG. 2 shows a detail in section according to II—II of FIG. 1.
Figure 3:
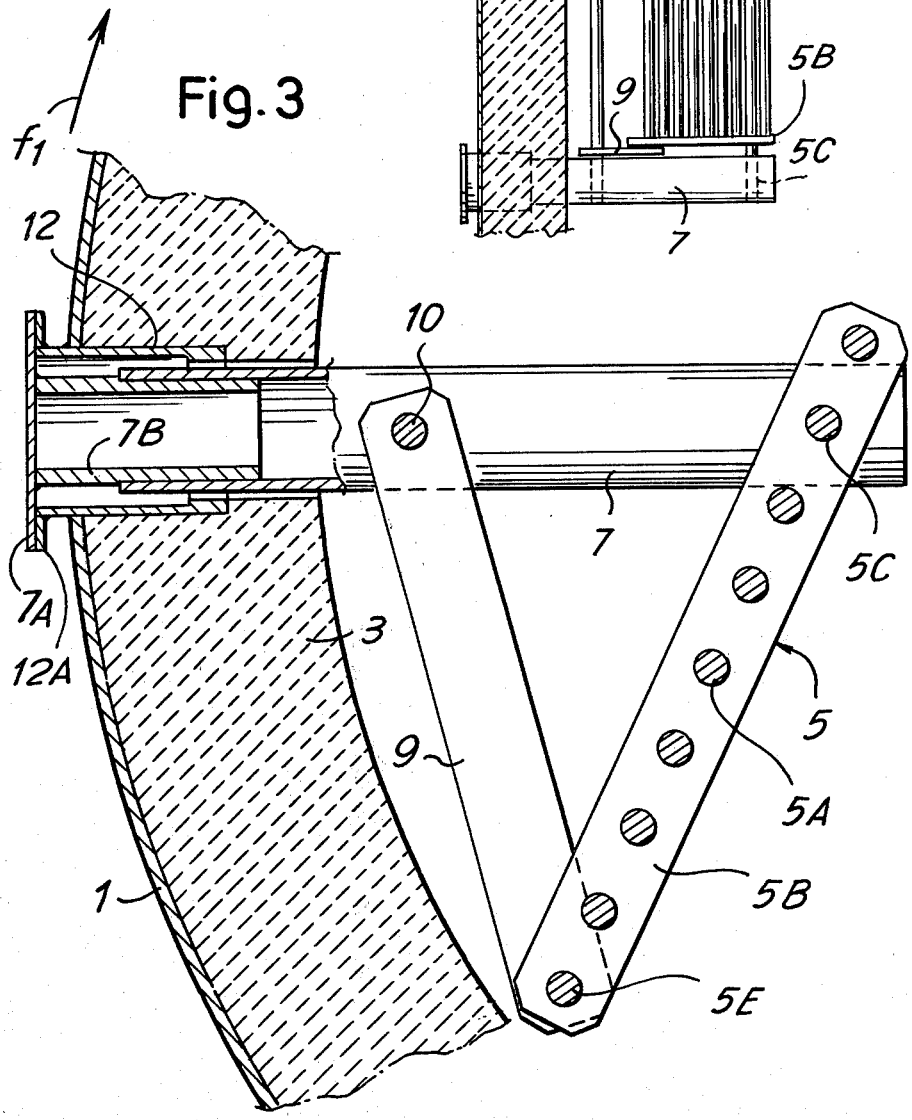
FIG. 3 shows an enlarged detail of FIG. 1.

According to what is illustrated in the attached drawing, 1 denotes the furnace outer shell, which is a part of the rigid structure of this, such structure being set up in order to be able to rotate according to the axis of the furnace cylindrical unit; said axis is slightly inclined with respect to the horizontal line.

3 denotes a layer of refractory material or anyway heat-proof and fire-proof insulating material.

Inside the chamber defined by the unit 1, 3 several grids 5 are placed, extending towards the inside and in the direction of the furnace feed during the rotation, as shown by the arrow f1.

The grids 5 are formed by bars 5A and by connecting cross-pieces 5B especially at the ends. With 5C and 5E two constraint rods, are shown, which are also grid bars like those 5A. The constraint rod 5C is supported by a support bar 7 at each end of a grid 5. The rod 5E on the contrary is engaged to two small bars 9, one at each end of the grid 5; the two small bars 9 in their turn are engaged by means of a constraint rod 10 to the same support bars 7 supporting the rod 5C.

The support bars 7 are radial and extending inside the cylindrical wall 1, 3, so as to be easily demountable with respect to said structure. In order to fix the radial support bars 7 a support 12 with outer flange 12A is provided, into which the bar 7 can be inserted which is fastened to the flange 12A by means of a plate-shaped end 7A of the same bar; 7B denotes a fixed connecting member between the plate 7A and its own bar 7.

The cylindrical furnace inner members above described are easily demountable. By removing the constraint rods 5C and 10 through axial shifting, the grid is released from the support bars 7, and through the opposite operation fixing the grid becomes easy. After the disassembly of the bars 5C and 10 it is possible to extract the support bars 7 from the seats 12, 12A in which they are accommodated.

What I claim is:

1. A rotary cylindrical furnace for incinerating refuse and the like comprising:

an outer wall;

grid means mounted about the inner periphery of said outer wall;

with respect to the direction of rotation of said furnace, the forward edge of said grid means being spaced a greater distance apart from said outer wall than the rearward edge of said grid means so that said grid means are inclined with respect to said wall; and said grid means not extending into the central area of said furnace.

2. The rotary furnace as claimed in claim 1, wherein said grid means are mounted to radially extending support bars.

3. The rotary furnace as claimed in claim 2, wherein said support bars are constructed and arranged so as to be externally retractable into said outer wall.

4. The rotary furnace as claimed in claim 2, wherein said grid means are directly attached to said support bar at said forward edge, and wherein said support bar includes a link between said rearward edge of said grid means and said support.

5. The rotary furnace as claimed in claim 2, wherein said outer wall includes flange means, said support bar including means for releaseably engaging said flange means.

* * * * *